United States Patent [19]

Onaka

[11] 4,058,098

[45] Nov. 15, 1977

[54] CONTROL SYSTEM FOR USE IN EXHAUST GAS RECIRCULATION SYSTEM

[75] Inventor: Hidemi Onaka, Susono, Japan

[73] Assignee: Toyota Jidosha Kogyo Kabushiki Kaisha, Toyota, Japan

[21] Appl. No.: 665,803

[22] Filed: Mar. 11, 1976

[30] Foreign Application Priority Data

June 23, 1975 Japan ..... 50-74453

[51] Int. Cl.[2] ..... F02B 29/00

[52] U.S. Cl. ..... 123/119 A

[58] Field of Search ..... 123/119 A

[56] References Cited

U.S. PATENT DOCUMENTS

| | | | |
|---|---|---|---|
| 3,800,766 | 4/1974 | Schubeck | 123/119 A |
| 3,903,859 | 9/1975 | Aquino et al. | 123/119 A |

OTHER PUBLICATIONS

Dempsey, P. *Modern Guide to Auto Tuneup and Emission Control Servicing,* Tab Books, 1974, pp. 180–181.

*Primary Examiner*—C. J. Husar

*Assistant Examiner*—L. J. Casaregola

*Attorney, Agent, or Firm*—Stevens, Davis, Miller & Mosher

[57] ABSTRACT

A control system for use in an exhaust gas recirculation system of an internal combustion engine, in which part of exhaust gases is recirculated from an exhaust system to an intake system in an attempt to reduce the amount of harmful components contained in exhaust gases from the engine as well as to prevent lowering of the running performance of the engine, by controlling the aforesaid recirculation system. This control system includes: a recirculation control valve which controls a recirculation joint portion between the exhaust system and the intake system; a fuel control mechanism which increases the open, cross sectional area of a fuel metering member in a carburetor for compensating for the lowered running performance of the engine due to the exhaust gas recirculation; and a negative-pressure switching valve which selectively supplies an intake negative pressure to the recirculation control valve as well as to the control input end of the fuel control mechanism.

6 Claims, 5 Drawing Figures

CONTROL SYSTEM FOR USE IN EXHAUST GAS RECIRCULATION SYSTEM

BACKGROUND OF THE INVENTION

1. Field of the Invention

This invention relates to a control system for use in an exhaust gas recirculation system of an internal combustion engine, in which part of exhaust gases from the engine is recirculated to an intake system to reduce the amount of harmful components contained in exhaust gases, and more particularly to a control system which controls the exhaust gas recirculation system so as to prevent lowering in the running performance of the engine due to the aforesaid exhaust gas recirculation.

2. Description of the Prior Art

It is known in the prior art that a part of exhaust gases may be returned to an intake system to dilute a mixture charge with inert gases for the purpose of lowering the combustion temperature, thereby reducing the amount of harmful components contained in exhaust gases, particularly nitrogen oxides (NOx). However, such an attempt poses the problem of lowering the running performance of an internal combustion engine. To avoid this shortcoming, an attempt has been proposed, in which ignition timing is controlled, coupled with the control of exhaust gas recirculation, in an attempt to compensate for the lowered running performance of an engine. The compensation for lowered running performance by an ignition timing control is indeed effective at a relatively high level of the nitrogen oxides, but difficult to attain at such a low level of the nitrogen oxide as required in current clean air legislation.

SUMMARY OF THE INVENTION

It is accordingly a principal object of the present invention to provide a control system for use in an exhaust gas recirculation system of an internal combustion engine, which permits the use of a relatively rich air-fuel mixture even in recirculation of a large amount of the exhaust gas, thereby stabilizing combustion and thus compensating for the lowered running performance without significant increase of the fuel consumption.

It is another object of the present invention to provide a control system for use in an exhaust gas recirculation system of an internal combustion engine of the type described, which may reduce to a great extent the amount of harmful components, particularly NOx, contained in exhaust gases due to a relatively low combustion-temperature.

According to the present invention, there is provided a control system for use in an exhaust gas recirculation system of an internal combustion engine, the aforesaid control system including: a recirculation-control valve which controls a recirculation joint portion between an exhaust system and an intake system; a fuel control mechanism which increases the open, cross sectional area of a fuel metering member in a carburetor, in an attempt to compensate for the running performance of an engine, which has been lowered due to exhaust gas recirculation; and a negative-pressure circuit which selectively supplies a negative pressure to the recirculation control valve as well as to the control input end of the fuel control mechanism.

The control input end of the negative-pressure switching valve is communicated by way of a valve means and/or a delay element with a drive energy source, whereby when the negative-pressure switching valve is actuated, it may be in response to any of the following: to an acceleration-transient condition, gear change position, cooling water temperature, vehicle speed and/or exhaust gas temperature. The negative-pressure switching valve controls the recirculation control valve and fuel control mechanism in a manner so that communication of the exhaust system with the intake system is interrupted, and concurrently the mixture charge is diluted.

More particularly, the aforesaid components or members in the aforesaid control system in the exhaust gas recirculation system are of an arrangement as follows: The recirculation control valve includes a valve body, valve stem or valve-manipulating rod, diaphragm, and diaphragm chamber, whereby the valve body is brought to its open position by means of the valve stem due to a negative pressure being supplied into the diaphragm chamber, thereby allowing the recirculation of exhaust gases from the exhaust system to the intake system. The fuel control mechanism includes a valve, valve stem and cylinder piston means, whereby a negative pressure being supplied to the aforesaid cylinder brings the valve body to its closed position by the medium of the valve stem, so that a mixture charge to be supplied to the internal combustion engine is diluted. The negative-pressure switching valve includes one or two inlets, two outlets, a valve body, a valve stem, diaphragms and diaphragm chambers, whereby the negative pressure being supplied into one diaphragm chamber allows switching of communicating paths from one path to another, while the aforesaid diaphragm chamber in the recirculation control valve or cylinder in the fuel control mechanism is communicated by way of the negative-pressure switching valve with a negative pressure source, which produces a negative pressure, depending on the opening of a throttle valve in the cylindrical portion of a carburetor, and one diaphragm chamber in the negative-pressure switching valve is communicated, by way of a negative-pressure delay valve and an electromagnetic valve, which is arranged in parallel with the aforesaid negative-pressure delay valve and controlled commensurate to the running condition of an engine, with a negative pressure source which produces a negative pressure commensurate to the opening of a throttle valve in the cylindrical portion of the carburetor. As a result, when the negative-pressure switching valve is actuated, the exhaust-gas recirculation path is closed and concurrently an additional fuel path for the fuel control mechanism is closed, so that recirculation of exhaust gases as well as concentration of a mixture charge may be controlled any time.

BRIEF DESCRIPTION OF THE INVENTION

DESCRIPTION OF THE PREFERRED EMBODIMENTS

Figure 1:
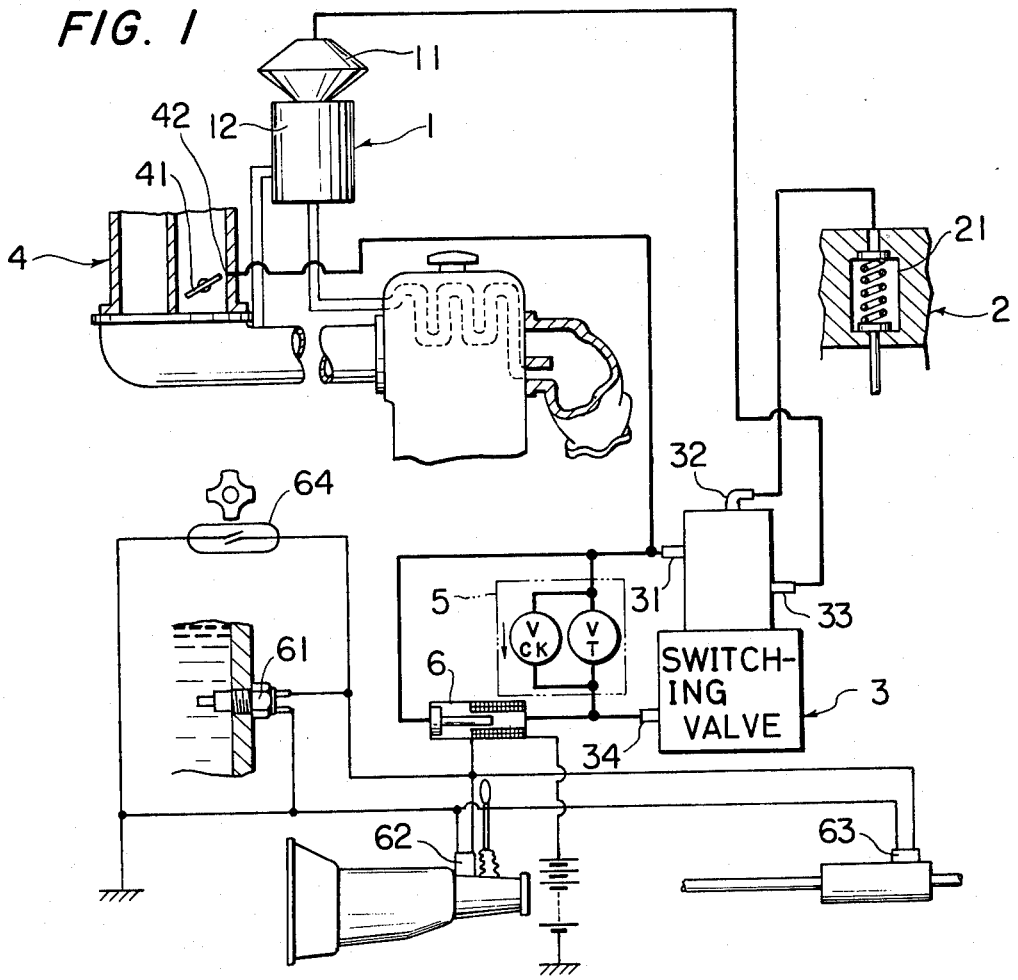
FIG. 1 is a block diagram illustrative of the control system according to the present invention.

Referring now to FIG. 1, there is diagrammatically shown a control system of the type described, according to the present invention. Shown at 1 is a recirculation control valve which opens and closes a recirculation path between an exhaust system and an intake system. A valve body to be described later, which is located within a valve portion 12, is actuated through the medium of a diaphragm and valve stem due to a negative pressure being supplied to a diaphragm chamber 11.

Shown at 2 is a fuel control mechanism. The open, cross section of a fuel metering member is closed when a negative pressure is supplied to a cylinder-piston means.

A negative-pressure switching valve 3 is provided with an inlet 31, outlets 32, 33 and a control inlet 34, and connected so that when a negative pressure is supplied to the control inlet 34, the inlet 31 is brought into communication with the outlet 32, while the outlet 33 is interrupted from communication therewith.

A carburetor 4 is provided with a throttle valve 41 and an opening 42 in a position to produce a negative pressure, when the opening of a throttle valve remains greater than a certain valve. The opening 42 is communicated with inlet 31 of the negative-pressure switching valve 3. On the other hand, the opening 42 is also communicated with control inlet 34 by way of a negative-pressure delay valve 5 and an electromagnetic valve 6 which are connected in parallel. An outlet 32 of the negative-pressure switching valve 3 is communicated with a cylinder 21 in the fuel control mechanism 2, while an outlet 33 of the valve 3 is communicated with a diaphragm chamber 11 in the recirculation control valve 1.

The negative-pressure delay valve 5 transmits a negative pressure which has been produced at opening 42 in the carburetor cylindrical portion 4, to the control inlet 34 of the negative-pressure switching valve 3 gradually.

The electromagnetic valve 6 also controls the transmission of the aforesaid negative pressure. According to the control in this embodiment of the present invention, the electromagnetic valve 6 is so designed as to be opened, in any of the following cases: when the temperature of the cooling water is below a certain value, such as below 60° C; when the transmission is at a given change gear position, for instance, at the fourth or fifth speed; when the vehicle speed exceeds a given value; and/or when the temperature of the exhaust gases is above a given value. The temperature of the water is detected at a water temperature detecting means 61; the position of the transmission at a transmission switch 62; the temperature of the exhaust gases at a temperature detecting means 63; and the vehicle speed at a vehicle-speed detecting means 64, respectively.

Now the description will be directed to operations of the control system according to the present invention as follows:

Firstly, assume that the throttle valve 41 is in its closed position, at the time of a no-load running mode of the internal combustion engine. At this time, practically no negative pressure prevails in the neighborhood of the opening 42, while the recirculation control valve 1, fuel control mechanism 2 and negative-pressure switching valve 3 are maintained in their initial positions. Thus, no recirculation of exhaust gases takes place. At this time, due to the normally open position of fuel control mechanism 2 an additional fuel path is opened so that a rich mixture charge may be supplied. However, since the throttle valve is in its closed position, the fuel control mechanism has no bearing on the running of the engine.

In case the temperature of the cooling water is below a given value, say 60° C, or in case the transmission is at a given change gear position, say, in the fourth speed or fifth speed mode, the coil of the electromagnetic valve 6 will be energized so that the electromagnetic valve 6 will be opened, bringing the opening 42 of the carburetor cylindrical portion into communication with the control inlet 34 of the negative-pressure switching valve 3. At this time, when the throttle valve is opened, a negative pressure will then prevail in the neighborhood of the opening 42 and be supplied to the control inlet 34. Thus, the negative-pressure switching valve 3 is actuated, and the inlet 31 is brought into communication with the outlet 32, while the outlet 33 is interrupted from communication therewith. As a result, negative pressure produced at this time is supplied to the cylinder 21 of the fuel control mechanism 2, thus closing the additional fuel path of the fuel control mechanism 2. At the same time, due to the cut-off of negative pressure the recirculation control valve 1 is in the position shown in FIG. 2. Accordingly, no recirculation of exhaust gases takes place while a lean mixture charge is supplied to the engine.

In case the temperature of the cooling water is above a given temperature or when the transmission is not in a given change gear position, the electromagnetic valve is maintained closed. Only during a given period of time immediately after the throttle valve 41 has been opened, the negative pressure prevailing in the neighborhood of the opening 42 acts only on the inlet 31 of the negative-pressure switching valve 3. This is because the passage of negative pressure from the opening 42 to the control inlet 34 is delayed by the action of the negative-pressure delay valve 5 positioned between the opening 42 and the control inlet 34. At this time, since the negative-pressure switching valve 3 is in its initial position, the negative pressure is transmitted to the diaphragm chamber 11 in the recirculation control valve 1. Since the fuel control mechanism 2 is in its initial position, recirculation of exhaust gases takes place so that a rich mixture charge is supplied to the engine.

When a negative pressure is transmitted to the diaphragm chamber 342 (see FIGS. 4 and 5) gradually and the negative pressure reaches a given value, the diaphragm 341 is lowered against the force of a spring 343, while the inlet 31 is brought into communication with the outlet 32, and the outlet 33 is interrupted from communication therewith. Accordingly, no recirculation of exhaust gases takes place, so that a lean mixture charge is supplied to the associated engine.

With the embodiment shown, when a negative pressure is supplied to the control inlet 34 of the negative-pressure switching valve 3, the recirculation of exhaust gases is interrupted. An alternative construction is shown in connection with FIG. 5 in which the negative-pressure switching valve 3 may be of such an arrangement that, when a negative pressure is supplied to the control inlet 34, recirculation of exhaust gases occurs, and when atmospheric pressure is supplied thereto, recirculation of exhaust gases is interrupted.

Figure 2:
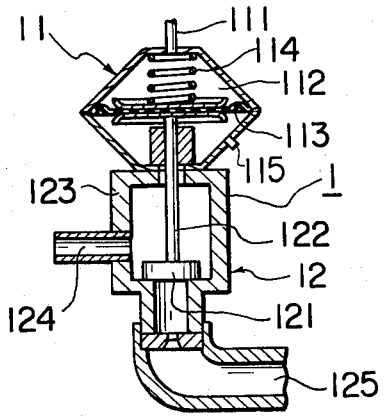
FIG. 2 is a cross sectional view of a recirculation control valve.

Referring to FIG. 2, a recirculation control valve 1 is shown in more detail. There are provided a diaphragm 113 and a spring 114 within the diaphragm chamber 11.

One compartment 112 in the diaphragm chamber 11 is communicated by way of a connecting pipe 111 and a further pipe leading to outlet 33 of the negative-pressure switching valve 3. When a negative pressure is not being supplied through the connecting pipe 111 to the diaphragm chamber 112, the diaphragm 113 assumes its initial position as shown, under the action of spring 114. A valve stem 122 is connected to the diaphragm 113 and extends through a valve housing 12 which is coupled to the wall of the diaphragm chamber 11. The valve stem 122 is secured to a valve body 121 within the valve housing 12. The valve housing 12 is provided with connecting pipes 124, 125 leading to the intake system and the exhaust system, respectively. The valve body 121 closes the connecting pipe 125 in its initial position as shown. Accordingly, the exhaust system is not communicated with the intake system in the FIG. 2 position of the valve body 121. When a negative pressure is supplied through the connecting pipe 111 in the diaphragm chamber 112, then the diaphragm 113 moves against the force of the spring 114, and the valve body 121 is detached from the valve seat, so that the exhaust system is brought into communication with the intake system. A vent 115 admits atmospheric pressure to the lower portion of the chamber 11.

Figure 3:
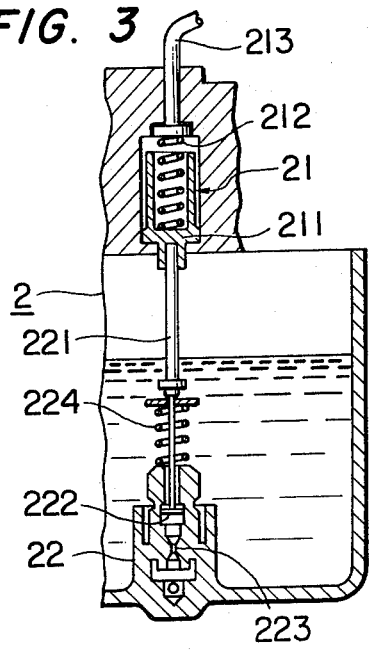
FIG. 3 is a cross sectional view showing the essential part of a float chamber in a fuel control mechanism.

FIG. 3 shows the fuel control mechanism. It has a piston 211 and a spring 212 within the cylinder 21. The interior of the cylinder 21 is communicated by way of connecting pipe 213 and a pipe leading thereto, with outlet 33 of the negative-pressure switching valve 3. When a negative pressure is not being supplied through the connecting pipe into the cylinder 21, the piston 211 assumes its normal position as shown, under the action of the spring 212. A fuel metering member 22 is formed with a fuel passage 223 which may be closed by a valve body 222. The valve body 222 is coupled to a valve stem 221 which is by spring action in the direction to close the valve. However, the force of the spring 224 is weaker than that of the spring 212, so that the valve body 222 is normally detached from its valve seat, assuming the position shown in FIG. 3. When a negative pressure is supplied through the connecting pipe 213 into the cylinder 21, then the piston 211 moves against the force of the spring 212, so that the valve body 222 is brought into contact with the valve seat, thus closing the fuel passage 223.

Figure 4:
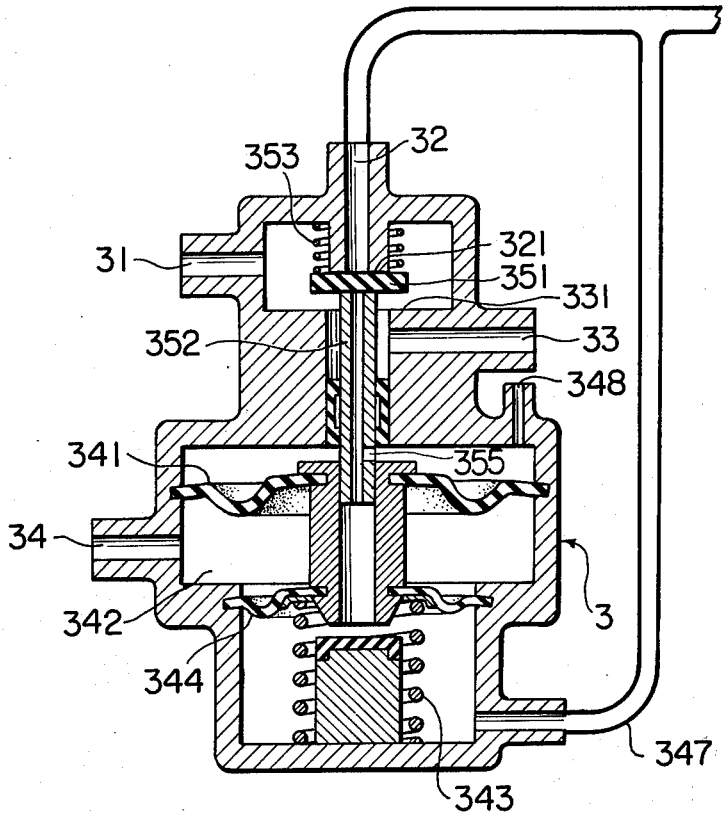
FIG. 4 is a cross sectional view of a negative-pressure switching valve.

FIG. 4 illustrates the construction of the negative-pressure switching valve. The control inlet 34 is in communication with a diaphragm chamber 342, in which there are provided two diaphragms 341, 344. The diaphragms 341, 344 have different diameters, with diaphragm 341 having a working surface larger than that of diaphragm 344. It follows from this that when a negative pressure is supplied through the control inlet 34 into chamber 342, the two diaphragms 341, 344 will be displaced in the direction of diaphragm 344, i.e., downwards as viewed in FIG. 4.

The diaphragm 341 has a valve stem 352 for manipulating a valve body 351. In the initial position shown, the valve stem 352 urges the valve body 351 against a valve seat 321. This is because the force of spring 343 is greater than that of spring 353.

As shown in FIG. 4 the upper portion of the diaphragm compartment is communicated through an opening 348 with the atmosphere, while the lower portion of the compartment of the diaphragm chamber is communicated by way of a pipe 347 with the outlet 32. The valve stem is of a hollow construction and the portion interconnecting the two diaphragms 341, 344 has a through-passage therein. The hollow portion in the valve stem 352 is communicated with the aforesaid through-passage, while the aforesaid hollow portion is communicated with the upper diagphragm compartment through an opening 355. As a result, in the initial position shown, the upper portion of the diaphragm compartment, and hence the outlet 32, is communicated through opening 348 with the atmosphere, while the inlet 31 is communicated with the outlet 33.

When a negative pressure is supplied through the control inlet 34 into the diaphragm chamber 342, then the diaphragm and hence the valve stem 352 moves downwards against the force of spring 343. The valve body 351 is attached to spring 353 and is brought into contact with the valve seat 331 under the action of it. Thus, the inlet 31 is brought into communication with the outlet 32. In this connection, the stroke of the valve body 351 is so designed as to be smaller than the stroke of the diaphragms 341, 344, so that the valve stem 352 moves away from the valve body 351, bringing the outlet 33 into communication with the atmosphere.

At this time, when a negative pressure is supplied through the inlet 31, the negative pressure is supplied by way of outlet 32 and pipe 347 into the lower diaphragm compartment. The above negative pressure behaves like a so-called positive feedback action, aiding in such a movement of the diaphragms.

Figure 5:
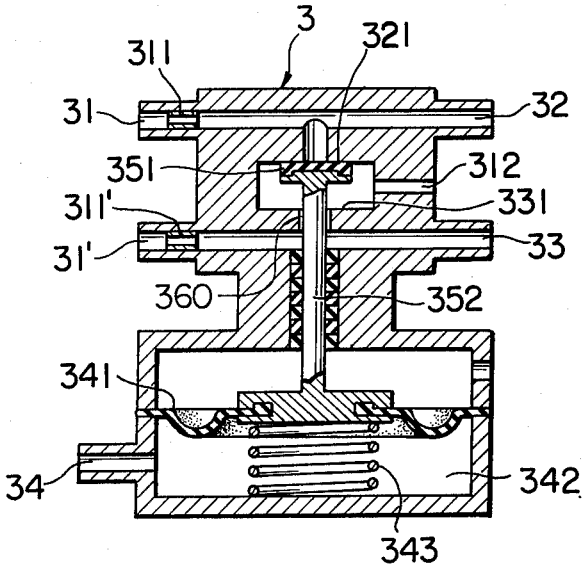
FIG. 5 is a cross sectional view of a second embodiment of the negative-pressure switching valve.

FIG. 5 shows the second embodiment of the negative-pressure switching valve. The negative-pressure switching valve shown in FIG. 5 is different in the following respects from that shown in FIG. 4: A single diaphragm is provided within the diaphragm chamber, and hence no pipe 347 is provided such as used in FIG. 4, while two inlets 31, 31' are provided. The inlets 31, 31' may be communicated with independent negative pressure sources, respectively. The inlets 31, 31' have throttles 311, 311', respectively.

Because of the provision of a single diaphragm, the construction of the negative-pressure switching valve shown in FIG. 5 is more simple. Valve stem 352 has a solid stem portion, and is secured to a valve body 351.

In the initial position shown, the valve body 351 contacts a valve seat 321 under the action of a spring 343. At this time, the inlet 31 is communicated with the outlet 32, while the inlet 31' is communicated with the outlet 33, respectively. However, the atmosphere communicating opening 312 defined in the housing portion, which houses the valve body 351 therein, is communicated with the outlet 33 by means of enlarged passage 360, and a throttle 311' is provided in the inlet 31', so that even if a negative pressure is supplied to the inlet 31', atmospheric pressure may be maintained in the outlet 33. On the other hand, the pressure prevailing in the outlet 32 is substantially of the same level as that in the inlet 31.

When a negative pressure is supplied through the control inlet 34 into the diaphragm chamber 342, the diaphragm 341, and hence the valve 351 moves against the force of spring 343, while the valve body 351 is brought into contact with the valve seat 331. At this time, the outlet 32 is communicated with the atmosphere, while the outlet 33 is brought into communication with the inlet 31'.

As best shown in FIG. 4, a single inlet 31 may be used, or otherwise the inlet 31 may be brought into communication either with the outlet 32 or with outlet 33 depending on the movement of the valve body 351.

In the embodiments shown, members which are responsive to the negative pressure in the fuel control mechanism, are shown in the form of cylinder-piston means. However, those members may be provided in the form of diaphragm means. While diaphragm means is used in the recirculation control valve as well as in the negative-pressure switching valve, a cylinder-piston means may be used therefor. Those members responsive to a negative pressure may be replaced by electromagnetic means, as the case may be.

It will be understood that the above description is merely illustrative of preferred embodiments of the invention. Additional modifications and improvements utilizing the discoveries of the present invention may be devised by those skilled in the art from the present disclosure, and such modifications and improvements may fairly be presumed to be within the scope and purview of the invention as defined by the claims that follow.

What is claimed is:

1. In a fuel system for use in an exhaust gas recirculation system of an internal combustion engine, wherein part of the exhaust gases from the exhaust system is recirculated to the engine intake system to reduce the amount of harmful components contained in the exhaust gases, as well as to prevent lowering in the running performance of the engine by controlling the recirculation of exhaust gases, the improvements comprising:

a vacuum operated recirculation control valve means connected between the engine intake and exhaust systems to control recirculation of exhaust gases between said exhaust system and said intake system;

a vacuum operated fuel control mechanism to increase the open, cross-sectional area of a fuel metering member in the engine carburetor, to compensate for the running performance of the engine, which has been lowered due to exhaust gas recirculation;

a negative-pressure switching valve to selectively communicate negative pressure to said recirculation control valve means as well as to fuel control mechanism, said negative-pressure switching valve including a valve body having at least one inlet and two outlets defining two communication paths therebetween, a valve stem, a diaphragm and a diaphragm chamber positioned so that a negative pressure supplied to a compartment of said diaphragm chamber effects switching of communication from one path to the other;

means connecting said fuel control mechanism with one outlet of said negative-pressure switching valve;

means connecting said recirculation control valve with the other said outlet;

means connecting the diaphragm compartment of said negative-pressure switching valve to at least one of a delay element or a delay by-pass valve;

means to actuate said delay by-pass valve comprising means to sense at least one of the following: an acceleration-transient condition; a change gear position; cooling water temperature; vehicle speed; or exhaust gas temperature;

means connecting said delay element and said delay by-pass to the engine carburetor air intake so that the operation of the switching valve is controlled commensurate to the running condition of the engine, the engine vacuum being commensurate with the opening of the throttle valve in the engine carburetor; whereby when said negative-pressure switching valve is actuated, a recirculating path for exhaust gases is closed, and concurrently an additional fuel passage for said fuel control mechanism is closed, thereby controlling both the recirculation of exhaust gases and the concentration of the mixture charge.

2. A control system as set forth in claim 1, wherein said recirculation control valve includes a valve body, a valve stem, a diaphragm and a diaphragm chamber, positioned so that a negative pressure supplied to a compartment of said diaphragm chamber opens said valve body by the medium of said valve stem, to provide communication between said exhaust system and said intake system for recirculation of exhaust gases.

3. A control system as set forth in claim 5, wherein said fuel control mechanisms includes a valve body, a valve stem and vacuum responsive means, connected so that a negative pressure supplied to said vacuum responsive means brings said valve body to its closed position, so that a mixture charge to be supplied to the engine is diluted.

4. The control system of claim 3 wherein said vacuum responsive means is a cylinder-piston means.

5. The system of claim 1 in which the delay element and the delay by-pass valve are connected in parallel.

6. The system of claim 5 in which the delay by-pass valve is an electromagnetic valve.

* * * * *